US006557353B1

(12) United States Patent
Fusco et al.

(10) Patent No.: US 6,557,353 B1
(45) Date of Patent: May 6, 2003

(54) APPARATUS AND METHOD FOR COOLING AN OBJECT

(76) Inventors: Michael A. Fusco, County Rte. 125, Chaumont, NY (US) 13622; Todd J. Badalato, 372 Pawling St., Watertown, NY (US) 13601

( * ) Notice: Subject to any disclaimer, the term of this patent is extended or adjusted under 35 U.S.C. 154(b) by 63 days.

(21) Appl. No.: 10/056,406

(22) Filed: Jan. 25, 2002

(51) Int. Cl.[7] ..... F25B 21/02
(52) U.S. Cl. ..... 62/3.2; 62/3.5
(58) Field of Search ..... 62/3.2, 3.3, 3.5, 62/371, 451.1, 457.9, 259.3, 261; 165/46

(56) References Cited

U.S. PATENT DOCUMENTS

| | | | | |
|---|---|---|---|---|
| 2,991,627 A | * | 7/1961 | Suits | 62/3 |
| 3,136,577 A | * | 6/1964 | Richard | 297/180 |
| 3,648,469 A | * | 3/1972 | Chapman | 62/3 |
| 3,916,911 A | * | 11/1975 | Sauder et al. | 128/400 |
| 4,759,190 A | | 7/1988 | Trachtenberg et al. | |
| 4,859,250 A | | 8/1989 | Buist | |
| 5,319,937 A | | 6/1994 | Fritsch et al. | |
| 5,448,788 A | | 9/1995 | Wu | |
| 5,609,032 A | * | 3/1997 | Bielinski | 62/3.7 |
| 5,704,223 A | | 1/1998 | MacPherson et al. | |
| 6,000,225 A | | 12/1999 | Ghoshal | |
| 6,006,524 A | | 12/1999 | Park | |
| 6,026,646 A | | 2/2000 | Hansen et al. | |
| 6,237,531 B1 | | 5/2001 | Peeples et al. | |
| 6,308,519 B1 | | 10/2001 | Bielinski | |

* cited by examiner

*Primary Examiner*—Denise L. Esquivel
*Assistant Examiner*—Melvin Jones
(74) *Attorney, Agent, or Firm*—Bond, Schoeneck & King, PLLC

(57) ABSTRACT

A thermoelectric apparatus includes a power source, a body having a first side and a second with a defined perimeter where the first side and the second side are separated by a gap. It further includes an insulation means for providing a thermal barrier, a cooling means placed between the first side and the second side for cooling an object and a connecting means for securing the body into a defined shape around an object.

A method of operating a thermoelectric apparatus includes wrapping a body around an object, with the body having a first side and a second side, a defined perimeter and the first side and second side separated by a gap containing an insulation means that forms a thermal barrier. Another step is engaging a connecting means for securing said body into a defined shape around the object, engaging a power source and then operating a cooling means placed between the first side and second side of the body in the gap for cooling the object.

33 Claims, 4 Drawing Sheets

APPARATUS AND METHOD FOR COOLING AN OBJECT

FIELD OF THE INVENTION

The present invention relates to cooling an object, and more particularly to an apparatus and method that provides lower than ambient temperatures surrounding an object.

BACKGROUND OF THE INVENTION

Coolers are typically in the form of an insulated container that has walls upstanding from a base to define a top opening where a removable cover is mounted. These coolers are typically rectangular with two side walls and two end walls, and have a pivotal handle assembly mounted to each end wall for carrying the cooler. The conventional coolers are intended to be disposed solely on the bottom or back wall. The lid whether or not hinged along one edge is simply locked with the container by a friction fit and/or by engagement. There are pivotally mounted locking carrying handles which selectively engage and hold the lid on the container.

Typically coolers of this type are used as chests wherein food is placed within the container and ice is added to it to maintain the food at a cool temperature. The design of the container has its disadvantages when used to store the butchered carcass of a wild game kill or a large object that needs to be kept cool. For example, once a whitetail deer is brought down and dead the hunter must field dress the deer. This includes rolling a deer onto its back, with its head pointed uphill, and then cutting open the deer removing its internal organs from the body cavity. Once the deer's cavity is clear the carcass must be cooled quickly. Typically the hunter will hang the carcass with the hide-on, spreading the ribs with a stick to expose the cavity to ambient temperatures. However, if the ambient temperature is about 45° F. or more the carcass will quickly spoil. Consequently, the hunter must skin and butcher the deer in the field. This is difficult because the deer must be cut into many pieces that allow the meat to fit into the ice chest. Furthermore, to save most of the deer carcass many chests and alot of ice is required.

Most hunters find it to difficult to butcher and store wild game in the field. If the ambient temperature is about 45° F. they either cut short their hunting trip or allow the carcass to spoil. What is needed is an apparatus that is portable and will keep the carcass cool and thereby slowing down the spoilage process of the shot wild game. Furthermore, what is also needed is an apparatus that can conveniently surround any object and keep the object cool.

SUMMARY OF THE INVENTION

It is an aspect of the invention to provide an apparatus that will slow the spoilage of a wild game carcass.

It is another aspect of the invention to provide an apparatus for cooling wild game carcass that is portable, easy to use and lightweight.

It is still another aspect of this invention to provide an apparatus for conveniently cooling any object.

To accomplish these aspects a thermoelectric apparatus includes a power source, a body having a first side and a second with a defined perimeter where the first side and the second side are separated by a gap. It further includes an insulation means for providing a thermal barrier, a cooling means placed between the first side and the second side for cooling an object and a connecting means for securing the body into a defined shape around an object.

A method of operating a thermoelectric apparatus includes wrapping a body around an object, with the body having a first side and a second side, a defined perimeter and the first side and second side separated by a gap containing an insulation means that forms a thermal barrier. Another step is engaging a connecting means for securing said body into a defined shape around the object, engaging a power source and then operating a cooling means placed between the first side and second side of the body in the gap for cooling the object.

DETAIL DESCRIPTION OF THE INVENTION

While the present invention is described below with reference to cooling wild game, a practitioner in the art will recognize the principle of the present invention is applicable elsewhere.

Figure 1:
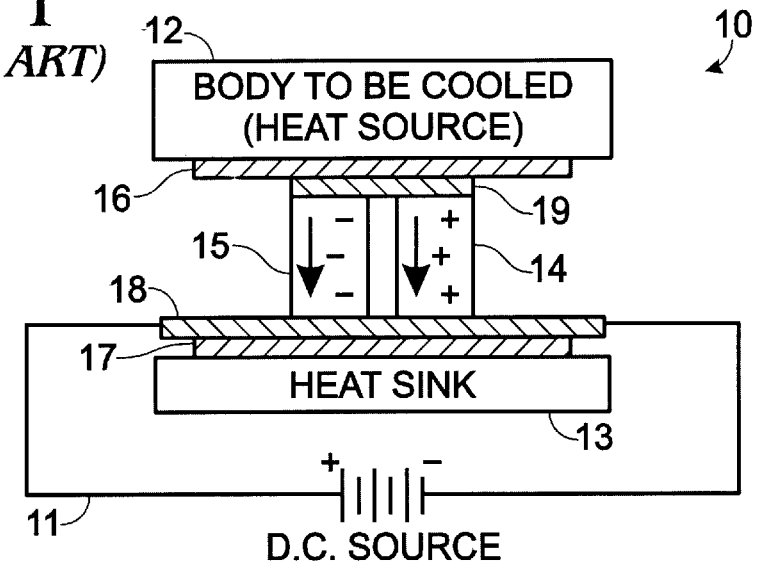
Fig. 1 (PRIOR ART)
FIG. 1 is a cross section of a typical thermoelectric couple used in the preferred embodiment of the invention.

FIG. 1 shows the cross section assembly 10 of a typical thermoelectric couple used as the cooling means in the preferred embodiment of the invention. Thermoelectric coolers (TECs) are solid state heat pumps used where temperature stabilization, temperature cycling, or cooling below ambient temperature are required. A direct current 11 when applied across two dissimilar materials causes a temperature differential between a heat source 12 and a heat sink 13. Furthermore, if the temperature differential across the TEC is less than 55° C. then a single stage thermoelectric cooler is sufficient. However, if the temperature differential across the TEC is greater than 55° C. then a multistage TEC is required.

The typical TEC is manufactured using a first thin electric insulator 16 and a second thin electric insulator 17. A series of P-type bismuth-telluride semiconductor material 14 and N-type bismuth-telluride semiconductor material 15 is sandwiched between the first and second ceramic substrate. The ceramic material, on both sides of the thermoelectric, adds rigidity and the necessary electrical insulation. The N-type material 15 has an excess of electrons, while the P-type material 14 has a deficit of electrons. One P-type and one N-type make up a couple. The thermoelectric couples are electrically connected in series through a first electrical connector 18 and a second electrical connector 19. The thermoelectric couples are connected thermally in parallel. Furthermore, a thermoelectric module can contain from one to several hundred couples depending on the cooling requirement.

As the electrons move from the P-type material 14 to the N-type material 15, through a second electrical connector 19, the electrons jump to a higher energy state. Thus thermal energy is absorbed at the heat source 12 or cold side. Continuing through the lattice of material the electrons flow from the N-type material 15 to the P-type material 14 through a first electrical connector 18. The electrons drop to a lower energy state releasing energy as heat to the heat sink 13 or hot side.

The appropriate thermoelectric application depends on three parameters. These parameters are the hot surface temperature $T_h$, the cold surface temperature $T_c$, and the heat load to be absorbed at the cold surface $Q_c$. The hot side or heat sink 13 of the thermoelectric is the side where heat is released when DC power 11 is applied. In a typical application the heat sink is air that is naturally convected. The hot side temperature can be found by using Equations (1) and (2).

$$T_h=T_{amb}+(\theta)(Q_h) \quad (1)$$

Where $T_h$=The hot side temperature (°C.).

$T_{amb}$=The ambient temperature (°C.).

θ=Thermal resistance of the heat exchanger (°C./watt).

And $$Q_h=Q_c+P_{in} \quad (2)$$

Where $Q_h$=The heat released to the hot side of the thermoelectric (watts).

$Q_c$=The hear absorbed from the cold side (watts).

$P_{in}$=The electrical input power to the thermoelectric (watts).

The thermal resistance of the heat sink causes a temperature rise above ambient. The heat sink is a key component in the assembly. A heat sink that is too small means that the desired cold side temperature may not be obtained. The cold side of the thermoelectric is the side that gets cold when DC power is supplied. This side may need to be colder than the desired temperature of the cooled object. This is especially true when the cold side is not in direct contact with the object, for example, when cooling an enclosure. The temperature difference across the thermoelectric ΔT relates to $T_h$ and $T_c$ according to Equation 3.

$$\Delta T=T_h-T_c \quad (3)$$

In estimating $Q_c$ the heat load in watts absorbed from the cold side all thermal loads and other heat load factors in the design are considered. These include the heat load from the object intended to be cooled, the transient load that is the time required to change the temperature of the object being cooled and radiation, convection or conductive losses/gains.

All thermoelectric coolers are rated for $I_{max}$, $V_{max}$, $Q_{max}$ and $\Delta T_{mas}$, at a specific value of $T_h$. All TECs operating at or near the maximum power are inefficient due to internal heating of the device at high power. TECs in various applications are designed to operate at about 25% to 80% of $I_{max}$. The input power to the thermoelectric cooler determines the hot side temperature and cooling capability at a specific load. As the TECs operate the current flowing through it has both a cooling effect and a heating effect. The heating effect is proportional to the square of the current. Consequently, as the current increases the heating effect dominates the cooling effect and causes a loss in net cooling. The current where a net loss in cooling occurs is the $I_{max}$ of the thermoelectric. Furthermore, for each TEC device, $Q_{max}$ is the maximum heat load that can be absorbed by the cold side of the thermoelectric cooler (TEC). This maximum occurs at $I_{max}$, $V_{mas}$ and with ΔT=0° C. The $\Delta T_{max}$ value is the maximum temperature difference across the TEC. This maximum occurs at $I_{max}$, $V_{max}$ and with no load $Q_c$=0 (watts).

The material used for assembly 10, and in more particular the heat sink 13 and heat side 12 mounting surface, is constructed out of materials that have a high thermal conductivity, for example, copper or aluminum. This is to promote heat transfer. However, the first electric insulator 16 and second electric insulator 17 are constructed out of materials with low electrical conductivity and high thermal conductivity such as a ceramic wafer. This is to both insulate the TEC electrically as required and promote a high heat transfer rate. Finally, environmental concerns such as humidity and condensation on the cold side or heat source 12 are alleviated by using proper sealing methods. For example, a perimeter seal around the TEC protects the couples from contacting fluids that eliminates corrosion, thermal shorts and electrical shorts that damage the TEC module.

Figure 2:
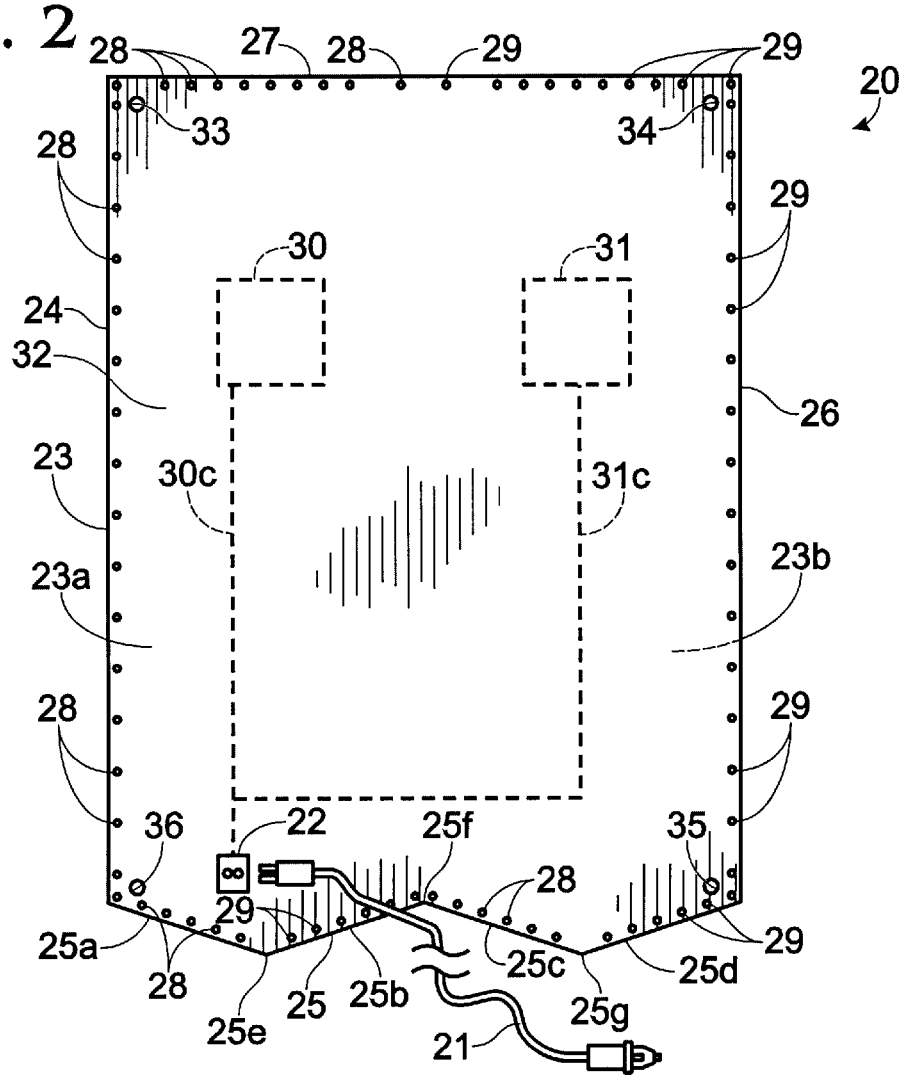
FIG. 2 is a plan view of the cooling apparatus in the preferred embodiment of the invention.

FIG. 2 is a plan view of the thermoelectric cooler apparatus 20 that is the cooling means of the preferred embodiment of the invention. A power source 21 is externally provided and connects to a female insulated receptacle 22 that is mounted on a body 23. The power source is a low voltage DC supply, typically about 12 volts. The power source can be provided by a DC battery or through the cigarette lighter connection provided in all motorized vehicles. Furthermore, a 110 volt power supply is substitutable with the proper step down transformer converting the 110 volt AC power to about 12 volts DC. The receptacle 22 is positioned as desired on body 23. Alternately, the external DC power supply is substitutable for an internal DC power supply (not shown), for example, a 12 volt battery, that is positioned conveniently and secured on body 23.

The body 23 includes a first side 23*a* and a second side 23*b* within a defined perimeter that is about eight feet long by about six feet wide. However, these dimensions are substitutable for any value depending on the application. The perimeter includes a first edge 24, a second edge 25, a third edge 26 and a fourth edge 27. The first side 23*a* and second side 23*b* is separated by a gap large enough to fit an insulation means 32, a first TEC 30, and a second TEC 31, between the first side 23*a* and the second side 23*b*. The insulation means 32 provides a thermal barrier between the first side 23*a* and the second side 23*b*. The first edge 24 of the first side 23*a* is connected to the first edge 24 of the second side 23*b*.

A piping is secured around the first edge 24 of the first side 23*a* and second side 23*b*. The second edge 25 of the first side 23*a* is connected to the second edge 25 of the second side 23*b*. A piping is secured around the second edge 25 of the first side 23*a* and second side 23*b*. The third edge 26 of the first side 23*a* is connected to the third edge 26 of the second side 23*b*. A piping is secured around the third edge 26 of the first side 23*a* and second side 23*b*. Finally, the fourth edge 27 of the first side 23*a* is connected to the fourth edge 27 of the second side 23*b*. A piping is secured around the fourth edge 27 of the first side 23*a* and second side 23*b*.

The first, third and fourth edges are typically straight. A practitioner in the art readily understands that the straight edges are substitutable for curved, inclined or various shapes as desired. The second edge 25 includes tapered edges 25*a*, 25*b*, 25*c* and 25*d*. The second edge 25 is constructed with a first protrusion 25*e*, an indentation 25*f* and a second protrusion 25*g*. The tapered edges are typically straight. However, a practitioner in the art readily understands the straight tapered edges 25*a,* 25*b,* 25*c* and 25*d* are substitutable for any desired shape. The indentation 25*f* is typically positioned about in the center of the second edge 25 of body 23. The first protrusion 25*e* is located about a quarter distance from the first edge 24 between the first edge 24 and third edge 26. The second protrusion 25*g* is located about a quarter distance from the third edge 26 between the first edge 24 and third edge 26. Finally, the first protrusion 25*e,* the indentation 25*f* and the second protrusion 25*g* are positioned on the second edge 25 of the body 23. This is to facilitate the drainage of fluids when the body 23 is wrapped around an object with the fourth edge 27 higher in elevation than the second edge 25.

A connecting means on body 23 includes a second connector 28 and a first connector 29. The first and second connectors secure the body 23 around an object after the body 23 is wrapped around the object. The body 23 conforms to the defined shape of the object. The connecting means includes a plurality of second connectors and first connectors as desired depending on the size of body 23. The first connector 29 is typically a female portion of a snap. A practitioner in the art readily understands the female portion of a snap is substitutable for half a zipper, a button hole, hook and loop fastener straps or tie-backs. The second connector 28 is typically a male portion of a snap. A practitioner in the art further understands the male portion of a snap is substitutable for half a zipper, a button hole, hook and loop fastener straps or tie-backs. The first connectors are positioned near and follow the contour of the third edge 26 and alternate on the second edge 25 second taper 25*b* and the second edge 25 fourth taper 25*d*. The first connectors further alternate on one half the fourth edge 27 and are located starting from the third edge 26. The second connectors are positioned near and follow the contour of the first edge 24 and alternate on the second edge 25 first taper 25*a* and the second edge 25 third taper 25*c*. The second connectors further alternate on one half the fourth edge 27 and are located starting from the first edge 24. Finally, the connecting means on body 23 forms the body into a defined shape of the object when wrapped around the object.

The body 23 further includes a first grommet 33, a second grommet 34, a third grommet 35 and a fourth grommet 36 for hanging the body 23 open when desired. The first grommet 33 is positioned at the corner where the first edge 24 and the fourth edge 27 communicate. The second grommet 34 is positioned at the corner where the fourth edge 27 and the third edge 26 communicate. The third grommet 35 is positioned at the corner where the third edge 26 and the second edge 25 communicate. Also, the fourth grommet 36 is positioned at the corner where the first edge 24 and the second edge 25 communicate. Furthermore the first grommet 33 center is positioned about 2.5 inches from the first edge 24 and fourth edge 27. The second grommet 34 center is positioned about 2.5 inches from the fourth edge 27 and the third edge 26. The third grommet 35 center is positioned about 2.5 inches from the third edge 26 and the second edge 25. Finally, the fourth grommet 36 center is positioned about 2.5 inches from the second edge 25 and the first edge 24. However, the grommet position is substitutable for any location depending on the application of body 23.

A cooling means is positioned between the first side 23*a* and second side 23*b* of body 23 in the gap that is formed. The cooling means includes a first thermoelectric cooler (TEC) 30 and a second thermoelectric cooler (TEC) 31 in the preferred embodiment of the invention. A practitioner in the art readily understands the number of thermoelectric coolers located between the first side 23*a* and second side 23*b,* in the body 23, varies depending on the application and the cooling required. The number of TECs are from one to as many as are needed for the cooling required. Typically, the first TEC 30 and the second TEC 31 are both positioned in the body 23 about one quarter the distance between the fourth edge 27 and second edge 25 starting from the fourth edge 27. The first TEC 30 and second TEC 31 typically are positioned at equal distances between the first edge 24 and third edge 26 of the body 23 and themselves. However, thermoelectric coolers are positioned in the body 23 as required for the application. Furthermore the first TEC 30 and the second TEC 31 are typically an epoxy sealing (EP) TEC. Alternately the first and second EP TEC are substitutable for a silicon (RTV), SealTec (ST) or conformal coating (EC) thermoelectric cooler depending on the application.

The EP TEC is a low-density lightweight syntactic epoxy resin for electronic encapsulation and perimeter sealing. When cured the matter is completely unicellular. Consequently, the moisture absorption is negligible. This material exhibits a low dielectric constant, low coefficient of thermal expansion and low cure shrinkage. The usable temperature range is from about −40 to +130° C.

A RTV TEC contains a perimeter seal that retains elastomeric properties over a wide temperature range. The non-corrosive material exhibits excellent electrical properties and UV, chemical and weather resistance. The usable temperature range is from about −60 to 204° C.

The ST TEC is a low cost perimeter seal to protect against the damage effects of wet applications, condensation and barrier for foam in place insulation techniques. The usable temperature range is from about −54 to 80° C.

The EC TEC contains a conformal coating that is a transparent general purpose dip epoxide surface coating used for coating electronic components for corrosion protection and high insulation resistance. The EC is not a perimeter seal and is usable in conjunction with a RTV. The usable temperature range is from about −55 to 150° C.

Figure 3:
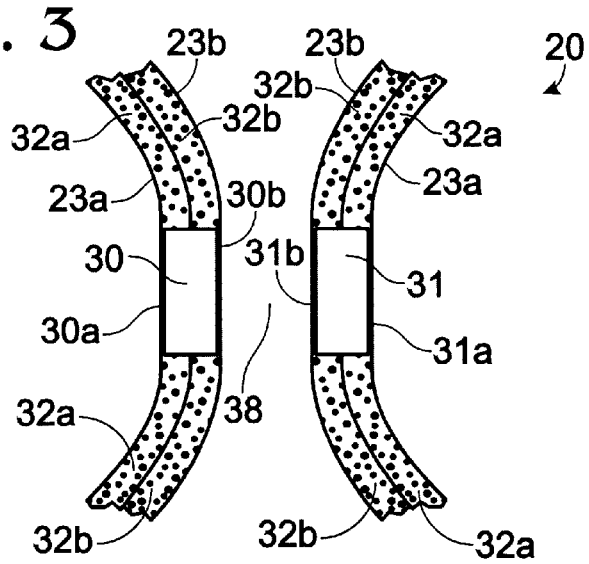
FIG. 3 is a cross section of the preferred embodiment of the invention.

An insulation means 32, as shown in FIG. 3, is positioned in the gap formed between the first side 23*a* and the second side 23*b* of the body 23. The insulation means 32 is typically a high thermal resistant material, for example, heat insulating plastic material, or the like. A practitioner in the art readily understands the insulating plastic material is substitutable for a variety of insulating fabrics, batts, foam and the like. The insulation means 32 further contains a top layer 32*a* communicating with the first side 23*a* and a bottom layer 32*b* communicating with the second side 23*b*. Finally, the insulation means 32 is a variety of materials including, but not limited to fiberglass, wool, foam, polystyrene, polyurethane and the like.

As shown in FIG. 2 a first electrical wire 30*c* is connected to the first TEC 30 and routed to the female receptacle 22. A second electrical wire 31*c* is connected to the second TEC 31 and routed to the female receptacle 22. The first electrical wire 30*c* and the second electrical wire 31*c* are electrically insulated and are routed sandwiched between the insulation means 32 top layer 32*a* and bottom layer 32*b*.

FIG. 3 shows a cross section of the thermoelectric cooler apparatus 20 in the preferred embodiment of the invention. The body 23 is surrounding an object 38 (not shown). The first TEC 30 is sandwiched between the first side 23*a* and the second side 23*b*. The second TEC 31 is sandwiched between the first side 23*a* and the second side 23*b*. The first and second TEC are secured in the body 23 so that there is maximum cooling of object 38. There is no insulation between the first TEC 30 top side 30*a* and the first side 23*a,* and the first TEC 30 bottom side 30*b* and the second side 23*b*. Also, there is no insulation between the second TEC 31 top side 31*a* and the first side 23*a*, and the second TEC 31 bottom side 31*b* and the second side 23*b*. The first side 23*a* and second side 23*b* communicate directly with the first TEC 30 and the second TEC 31. The positioning of the first TEC 30 and the second TEC 31 promotes heat transfer allowing cooling of the object 38. A top layer 32*a* of insulation and a bottom layer 32*b* of insulation fill the gap between the first side 23*a* and the second side 23*b*. The top and bottom layer of insulation communicate directly with the ends of the first TEC 30 and the second TEC 31.

The first side 23*a* and second side 23*b* is manufactured from a variety of high strength moisture resistant fabrics. The fabrics are a variety of colors to suit the taste of any individual. In the preferred embodiment of the invention the first side 23*a* is Toughtek, a neoprene bonded polyester fabric. This fabric is stretchable and consists of 100% polyester knit and is coated with a heavy textured coating of specially formulated neoprene rubber. The fabric is highly abrasion resistant and scuff proof with superior grip characteristics wet or dry. The second side 23*b* is a 20 gauge vinyl sheeting. This material is shatterproof and resists hot/cold temperatures, stains, acids and alkali. Furthermore, this material is formulated to protect against ultra-violet rays from the sun.

Figure 4:
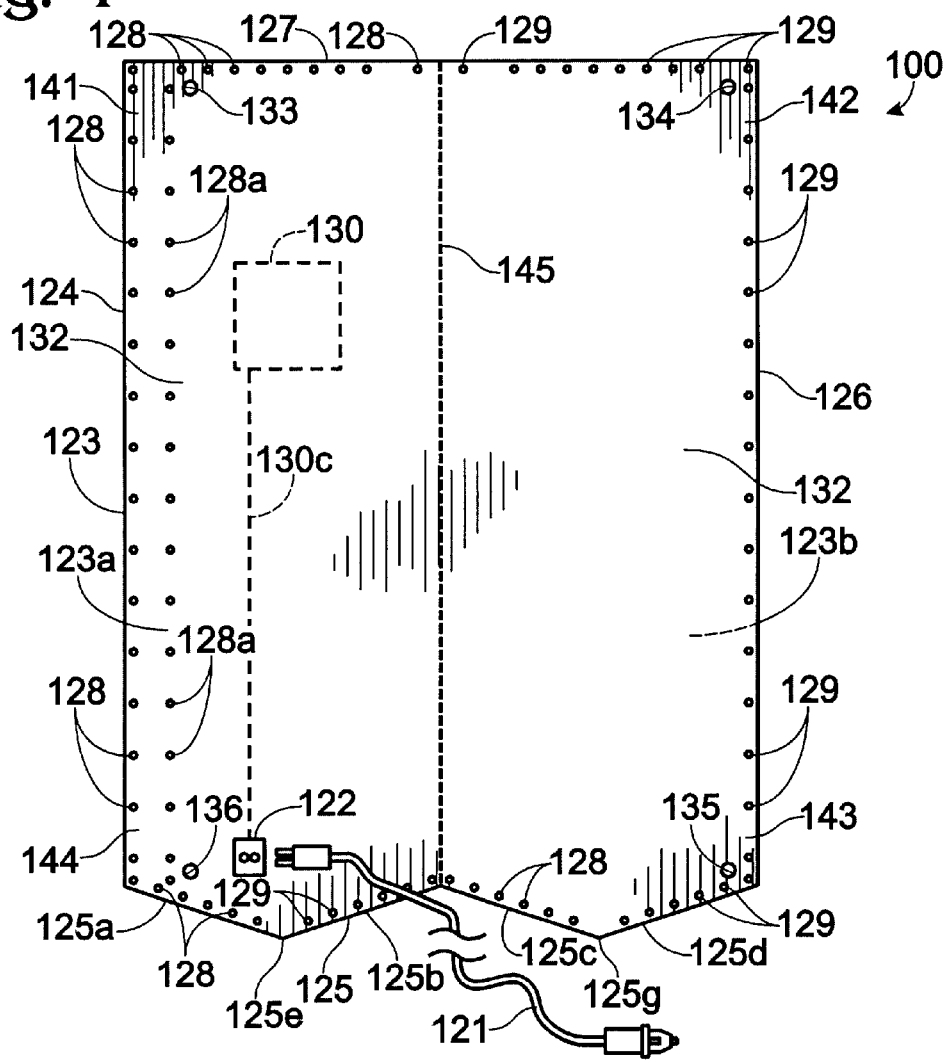
FIG. 4 shows a plan view of the cooling apparatus in another embodiment of the invention.

FIG. 4 shows cooling apparatus 100 in another embodiment of the invention. A power source 121 is externally provided and connects to a female insulated receptacle 122 that is mounted on a body 123. The power source is a low voltage DC supply, typically about 12 volts. The power source can be provided by a DC battery or through the cigarette lighter connection provided in all motorized vehicles. Furthermore, a 110 volt power supply is substitutable with the proper step down transformer converting the 110 volt AC power to about 12 volts DC. The receptacle 122 is positioned as desired on body 123. Alternately, the external DC power supply is substitutable for an internal DC power supply (not shown), for example, a 12 volt battery, that is position conveniently and secured on body 123.

The body 123 includes a first side 123*a* and a second side 123*b* within a defined perimeter that is about eight feet long by about six feet wide. However, these dimensions are substitutable for any value depending on the application. The perimeter includes a first edge 124, a second edge 125, a third edge 126 and a fourth edge 127. The first side 123*a* and second side 123*b* is separated by a gap large enough to fit insulation 132, and a TEC 130, between the first side 123*a* and the second side 123*b*. The insulation means 132 provides a thermal barrier between the first side 123*a* and the second side 123*b*. The first edge 124 of the first side 123*a* is connected to the first edge 124 of the second side 123*b*.

A piping is secured around the first edge 124 of the first side 123*a* and second side 123*b*. The second edge 125 of the first side 123*a* is connected to the second edge 125 of the second side 123*b*. A piping is secured around the second edge 125 of the first side 123*a* and second side 123*b*. The third edge 126 of the first side 123*a* is connected to the third edge 126 of the second side 123*b*. A piping is secured around the third edge 126 of the first side 123*a* and second side 123*b*. Finally, the fourth edge 127 of the first side 123*a* is connected to the fourth edge 127 of the second side 123*b*. A piping is secured around the fourth edge 127 of the first side 123*a* and second side 123*b*.

The first, third and fourth edges are typically straight. A practitioner in the art readily understands that the straight edges are substitutable for curved, inclined or various shapes as desired. The second edge 125 includes tapered edges 125*a*, 125*b*, 125*c* and 125*d*. The second edge 125 is constructed with a first protrusion 125*e*, an indentation 125*f* and a second protrusion 125*g*. The tapered edges are typically straight. However, a practitioner in the art readily understands the straight tapered edges 125*a*, 125*b*, 125*c* and 125*d* are substitutable for any desired shape. The indentation 125*f* is typically positioned about in the center of the second edge 125 of body 123. The first protrusion 125*e* is located about a quarter distance from the first edge 124 between the first edge 124 and third edge 126. The second protrusion 125*g* is located about a quarter distance from the third edge 126 between the first edge 124 and third edge 126. Finally the first protrusion 125*e*, the indentation 125*f* and the second protrusion 125*g* are positioned on the second edge 125 of the body 123. This is to facilitate the drainage of fluids when the body 123 is wrapped around an object with the fourth edge 127 higher in elevation than the second edge 125.

A connecting means on body 123 includes a second connector 128, a third connector 128*a* and a first connector 129. The first, or third, and second connectors secure the body 123 around an object after the body 123 is wrapped around the object. The body 123 conforms to the defined shape of the object. The connecting means includes a plurality of second and third connectors that connect to the first connectors to secure the body 123 around an object. Either the second or third connectors are used depending on the size of the object that the body 123 surrounds. This is so the body 123 fits tightly around an object. The first connector 129 is typically a female portion of a snap. A practitioner in the art readily understands the female portion of a snap is substitutable for half a zipper, a button hole, Hook and loop fastener straps or tie-backs. The second connector 128 and third connector 128*a* is typically a male portion of a snap. A practitioner in the art further understands the male portion of a snap is substitutable for half a zipper, a button hole, Hook and loop fastener straps or tie-backs. The first connectors are positioned near and follow the contour of the third edge 26 and alternate on the second edge 125 second taper 125*b* and the second edge 125 fourth taper 125*d*. The first connectors further alternate on one half the fourth edge 127 and are located starting from the third edge 126. The second connectors are positioned near and follow the contour of the first edge 124 and alternate on the second edge 125 first taper 125*a* and the second edge 125 third taper 125*c*. The second connectors further alternate on one half the fourth edge 127 and are located starting from the first edge 124. The third connectors 128*a* follow the contour of the first edge 124 and are positioned after the second connectors 128 starting from the first edge 124. The third connectors 128*a* are positioned on body 123 at any distance from the second connectors 128, wherein the distance varies from an inch to a few inches. Finally, the connecting means on body 123 forms the body into a defined shape of the object when wrapped around the object.

The body 123 further includes a first grommet 133, a second grommet 134, a third grommet 135 and a fourth grommet 136 for hanging the body 123 open when desired. The first grommet 133 is positioned at the corner where the first edge 124 and the fourth edge 127 communicate. The second grommet 134 is positioned at the corner where the fourth edge 127 and the third edge 126 communicate. The third grommet 35 is positioned at the corner where the third edge 26 and the second edge 125 communicate. Also, the fourth grommet 136 is positioned at the corner where the first edge 124 and the second edge 125 communicate. Furthermore the first grommet 133 center is positioned about 2.5 inches from the first edge 124 and fourth edge 127. The second grommet 34 center is positioned about 2.5 inches from the fourth edge 127 and the third edge 126. The third grommet 135 center is positioned about 2.5 inches from the third edge 126 and the second edge 125. Finally, the fourth grommet 136 center is positioned about 2.5 inches from the second edge 125 and the first edge 124. However, the grommet position is substitutable for any location depending on the application of body 123.

The body 123 further includes a first drawstring 141, a second drawstring 142, a third drawstring 143 and a fourth drawstring 144 that are positioned equidistant from the center 145. The first drawstring 141 is located near the first grommet 133. The second drawstring 142 is located near the second grommet 134. The third drawstring 143 is located near the third grommet 135 and the fourth drawstring 144 is located near the fourth grommet 136. However, the drawstrings are positionable at any location on body 123. The drawstrings are typically a nylon cord but the nylon cord is substitutable for any strong material.

A cooling means is positioned between the first side 123*a* and second side 123*b* of body 123 in the gap that is formed. The cooling means includes a thermoelectric cooler (TEC) 130 located so as to be positioned to provide maximum cooling of the object. For example, the TEC 130 would be placed in a body 123, that is designed to cool a deer carcass, so that the TEC 130 would be located at the chest cavity of the deer when apparatus 100 is wrapped around the deer. A practitioner in the art readily understands the number of thermoelectric coolers located between the first side 123*a* and second side 123*b*, in the body 123, varies depending on the application and the cooling required and is from one to as many as needed. Typically, the TEC 130 is positioned in the body 123 about one quarter the distance between the fourth edge 127 and second edge 125 starting from the fourth edge 127. This TEC is placed more toward the top of the body 123 because of the heat temperature rise factor. The TEC 130 is positioned on one side of the centerline 145 in body 123. However, one or more thermoelectric coolers are positioned in the body 123 as required for the application. Furthermore the TEC 130 is typically an epoxy sealing (EP) TEC. Alternately the first EP TEC is substitutable for a silicon (RTV), SealTec (ST) or conformal coating (EC) thermoelectric cooler depending on the application.

The EP TEC is a low-density lightweight syntactic epoxy resin for electronic encapsulation and perimeter sealing. When cured the matter is completely uni-cellular. Consequently, the moisture absorption is negligible. This material exhibits a low dielectric constant, low coefficient of thermal expansion and low cure shrinkage. The usable temperature range is from about −40 to +130° C.

A RTV TEC contains a perimeter seal that retains elastomeric properties over a wide temperature range. The non-corrosive material exhibits excellent electrical properties and UV, chemical and weather resistance. The usable temperature range is from about −60 to 204° C.

The ST TEC is a low cost perimeter seal to protect against the damage effects of wet applications, condensation and barrier for foam in place insulation techniques. The usable temperature range is from about −54 to 80° C.

The EC TEC contains a conformal coating that is a transparent general purpose dip epoxide surface coating used for coating electronic components for corrosion protection and high insulation resistance. The EC is not a perimeter seal and is usable in conjunction with a RTV. The usable temperature range is from about −55 to 150° C.

An insulation means 32, as shown in FIG. 3, is incorporated into the embodiment of FIG. 4. The insulation means is positioned in the gap formed between the first side 23*a* and the second side 23*b* of the body 23. The insulation means 32 is typically a high thermal resistant material, for example, heat insulating plastic material, or the like. A practitioner in the art readily understands the insulating plastic material is substitutable for a variety of insulating fabrics, batts, foam and the like. The insulation means 32 further contains a top layer 32*a* communicating with the first side 23*a* and a bottom layer 32*b* communicating with the second side 23*b*. Alternately, the insulation means 32, as shown in FIG. 5, is a one layer polystyrene or polyurethane material.

As shown in FIG. 4 an electrical wire 130*c* is connected to the TEC 130 and routed to the female receptacle 122. The electrical wire 130*c* is electrically insulated and is routed sandwiched between the body 123 first side 123*a* and second side 123*b* with the insulation means 132.

Figure 5:
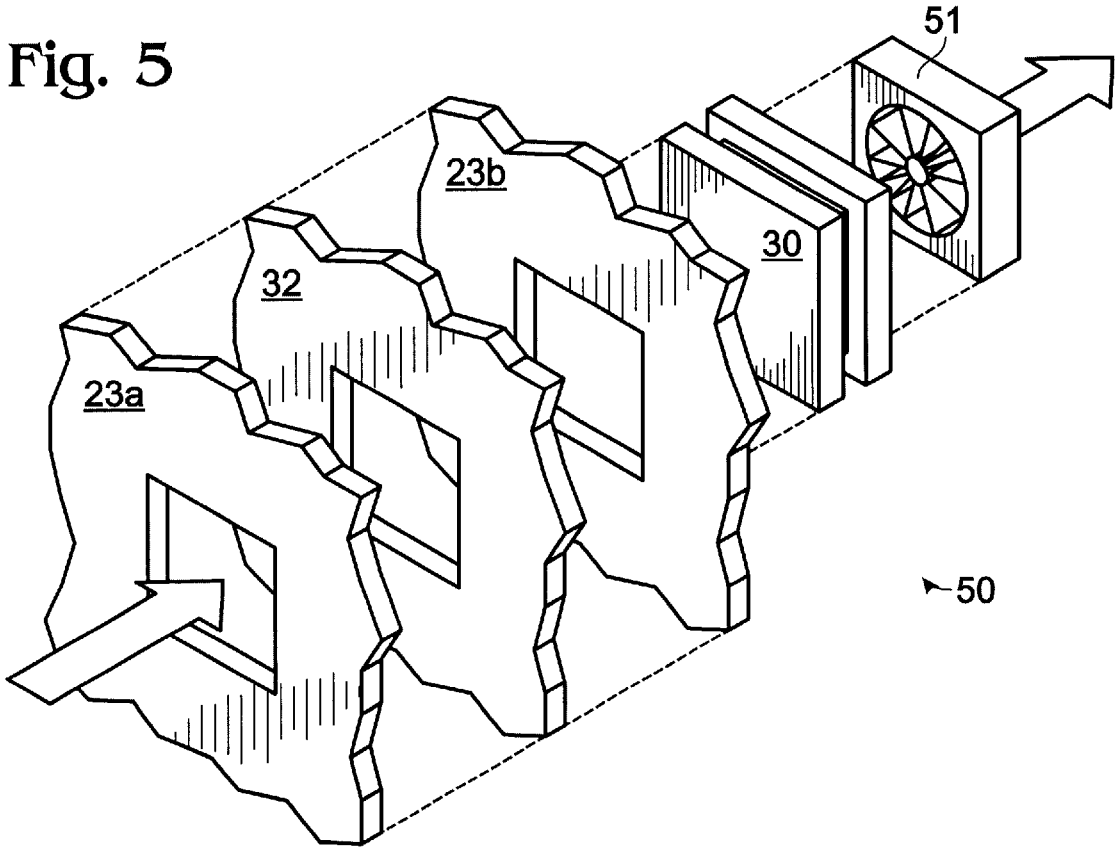
FIG. 5 shows an isometric view of a portion of the cooling apparatus with a fan in another embodiment of the invention.
Figure 6:
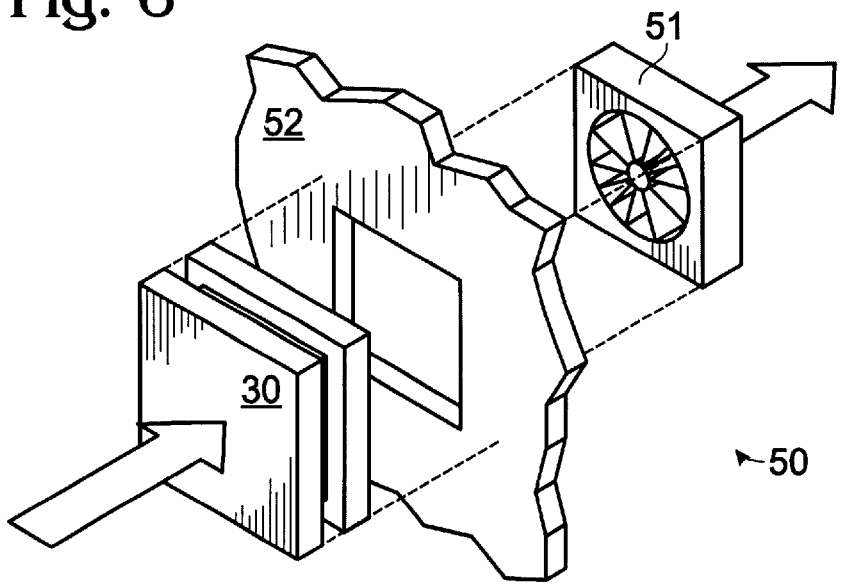
FIG. 6 shows an isometric detail of the cooling apparatus and a fan in another embodiment of the invention.

FIG. 5 and FIG. 6 shows apparatus 50 that includes a thermoelectric cooler 30 and fan 51. The fan 51 is used to facilitate cooling rates when used in conjunction with the TEC 30. For example, the TEC 30 releases the hot properties of the object being cooled and a small electric fan 51 pushes air to the outside of body 23 that is wrapped around the object to improve heat transfer characteristics. In essence, the fan 51 when used in conjunction with the TEC 30 lowers the energy required to cool an object. It also will provide additional cooling with less energy used to cool an object if only the TEC 30 and not the fan 51 was used to cool an object. The fan 51 and TEC 30 are aligned, attached and secured to a frame 52. The electric fan is a small fractional horsepower fan that is run on 12 volts DC. The frame 52 is typically plastic but plastic is substitutable for any material that is equally strong as plastic or provides greater strength than plastic. The fan 51 and TEC 30 are secured to the frame 51 by means of bolts, screws or fasteners depending on the application. The frame 51 is connected to a body 23 by placing the frame 51 between the first side 23*a* and second side 23*b* and stitching the frame 51 to and between both the first and second side. In other words the perimeter of the frame 51 is completely stitched into the body 23 securing it in place. An insulation means 32 is placed around the frame 51 between the first side 23*a* and second side 23*b*.

Figure 7:
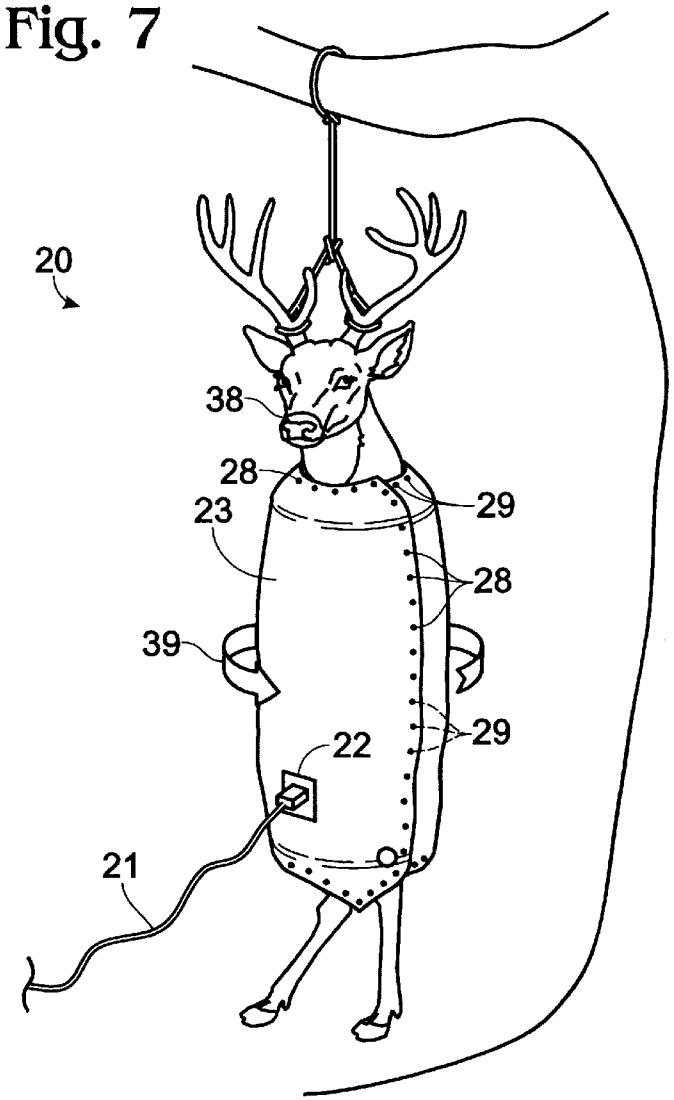
FIG. 7 shows a plan view of the cooling apparatus wrapped around a deer in the preferred embodiment of the invention.

FIG. 7 shows the preferred embodiment of the invention wrapped around an object 38 which, for example, is a deer. A method of operating a thermoelectric apparatus includes engaging a power source 21 that is connected to a receptacle 22. The power allows operating a cooling means placed between the first side 23*a* and second side 23*b* of the body 23. The next step is wrapping 39 a body 23, with a particular perimeter and having a first side 23*a* and a second side 23*b* that is separated by a gap, around the object 38. However, as understood by the practitioner in the art the deer is substitutable for any wild game or for that matter body 23 can be wrapped around any object to be cooled. Finally, a connecting means using the first connector 28 and second connector 29 is engaged for securing said body into a defined shape around the object 38.

Figure 8:
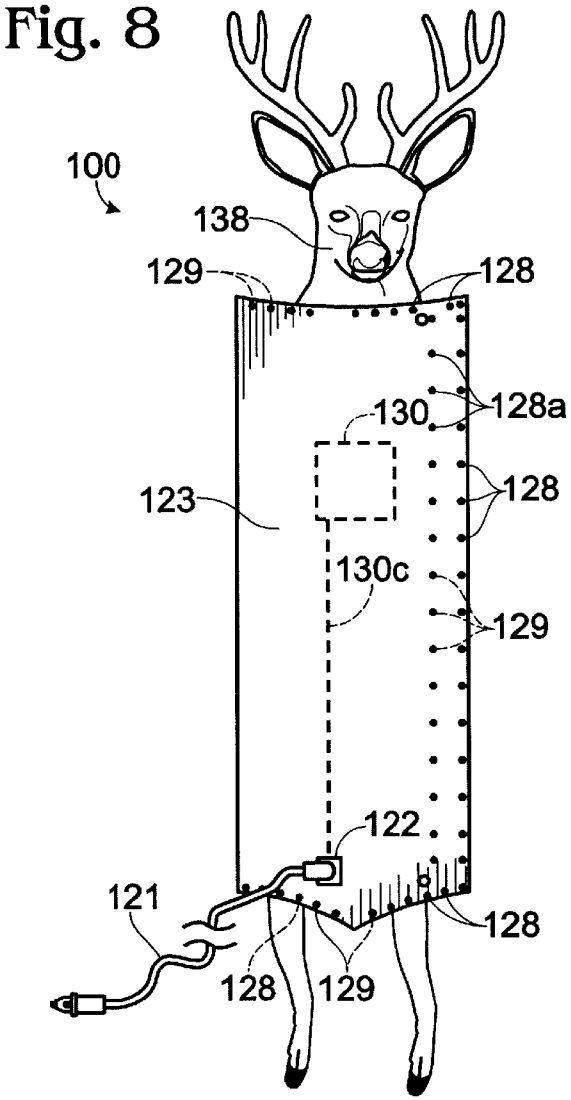
FIG. 8 show a plan view of the cooling apparatus wrapped around a deer in another embodiment of the invention.

FIG. 8 shows that apparatus 100 is wrapped around an object 138 which is, for example, a deer. The body 123 wraps from side-to-side that allows the thermoelectric cooler (TEC) 130 to lineup at the chest cavity of the deer which is the best location to refrigerate the deer meat. The body 123 then connects together at the first connection 128 and the second connection 129 around the neck and the feet of the deer. The connection around the feet and neck of the deer closes the body 123, at the second and fourth edges, assuring the TEC 130 adequately cools the deer meat. Also, the body 123 connects together on the side of the deer at the first connection 128 or the third connection 28*a* to the second connection 29 to tightly fit the body 23 to the deer. That is, the body 123 would connect the first and second connector together for a larger deer, while the body 123 would connect the second and third connector together for a smaller deer. The TEC 130 is located at the chest cavity of the deer releasing cold air into the gutted area for the best exposure. Once the deer has been wrapped like a sleeping bad with body 123, the power source 121 is connected to a female insulated receptacle 122 providing power through the electrical wire 130*a* to TEC 130.

While there has been illustrated and described what is at present considered to be a preferred embodiment of the invention, it will be appreciated that numerous changes and modifications are likely to occur to those skilled in the art.

It is intended in the appended claims to cover all those changes and modifications that fall within the spirit and scope of the present invention.

What is claimed is:

1. A thermoelectric apparatus comprising:

a) a power source;

b) a body having a first side and a second side with a defined perimeter wherein said first side and second side are separated by a gap for housing a cooling means;

c) said first side is a plurality of high strength moisture resistant fabrics;

d) said second side is a plurality of high strength moisture resistant fabrics;

e) an insulation means is located between said first side and second side for providing a thermal barrier to said cooling means;

f) said cooling means is positioned in said gap for cooling an object; and g) a connecting means for securing said body into a defined shape around said object.

2. The apparatus claimed in claim 1, wherein said perimeter further comprises a third edge with a plurality of second connectors.

3. The apparatus claimed in claim 1, wherein said perimeter further comprises a second edge and fourth edge with a combination of a first and second connector.

4. The apparatus claimed in claim 1, wherein said insulating means is a plurality of insulating materials.

5. The apparatus claimed in claim 1, wherein said fabrics are a plurality of colors.

6. The apparatus claimed in claim 1, wherein said body further comprises drawstrings constructed of various materials.

7. The apparatus claimed in claim 1, wherein said cooling means further comprises an electric fan and TEC connected to a frame secured to said body.

8. The apparatus claimed in clam 7, wherein said electric fan is a plurality of sizes.

9. The apparatus claimed in claim 1, wherein said perimeter is a plurality of shapes.

10. The apparatus claimed in claim 1, wherein said first and second connector are selected from the group consisting of a zipper, a female snap, a male snap, a button, a button hole, hook and loop fastener straps and tie-backs.

11. A method of operating a thermoelectric apparatus comprising:

a) wrapping a body around an object with said body having a first side and a second side, a defined perimeter and said first side and second side separated by a gap containing an insulation means that forms a thermal barrier;

b) engaging a connecting means for securing said body into a defined shape around said object.

c) engaging a power source; and d) operating a cooling means placed between said first side and second side in said gap for cooling said object.

12. The method of operating a thermoelectric apparatus as claimed in claim 11, wherein said perimeter further comprises a first edge, a second edge, a third edge and a fourth edge.

13. The method of operating a thermoelectric apparatus as claimed in claim 12, wherein said first, second, third and fourth edges are a plurality of shapes.

14. The method of operating a thermoelectric apparatus as claimed in claim 12, wherein said first edge further comprises a plurality of first connectors.

15. The method of operating a thermoelectric apparatus as claimed in claim 12, wherein said third edge further comprises a plurality of second connectors.

16. The method of operating a thermoelectric apparatus as claimed in claim 12, wherein said second edge and fourth edge further comprises a combination of a first connector and second connector.

17. The method of operating a thermoelectric apparatus as claimed in claim 11, wherein said connecting means further comprises a first connector and a second connector.

18. The method of operating a thermoelectric apparatus as claimed in claim 17, wherein said first connector is selected from the group consisting of a zipper, a female portion of a snap, a button hole, Hook and loop fastener straps, and tie-backs.

19. The method of operating a thermoelectric apparatus as claimed in claim 17, wherein said second connector is selected from the group consisting of a zipper, a male portion of a snap, a button, Hook and loop fastener straps, and tie-backs.

20. The method of operating a thermoelectric apparatus as claimed in claim 11, wherein said power supply is selected from the group consisting of internal and external.

21. The method of operating a thermoelectric apparatus as claimed in claim 20, wherein said external power supply is selected from the group consisting of a 12 DC volt battery, a 12 DC volt automobile cigarette lighter, and 110 AC volt with step-down transformer.

22. The method of operating a thermoelectric apparatus as claimed in claim 20, wherein said internal power supply is a 12 DC volt battery.

23. The method of operating a thermoelectric apparatus as claimed in claim 11, wherein said first side is a plurality of high strength moisture resistant fabrics.

24. The method of operating a thermoelectric apparatus as claimed in claim 11, wherein said second side is a plurality of high strength moisture resistant fabrics.

25. The method of operating a thermoelectric apparatus as claimed in claim 11, wherein said cooling means is a sealed thermoelectric cooler.

26. The method of operating a thermoelectric apparatus as claimed in claim 25, wherein said thermoelectric cooler is selected from the group consisting of an EP cooler, a RTV cooler, a ST cooler, and an EC cooler.

27. The method of operating a thermoelectric apparatus as claimed in claim 25, wherein said thermoelectric coolers are selected from the group consisting of an EP cooler, a RTV cooler, a ST cooler, and an EC cooler.

28. The method of operating a thermoelectric apparatus as claimed in claim 11, wherein said cooling means is a plurality of sealed thermoelectric coolers.

29. The method of operating a thermoelectric apparatus as claimed in claim 11, wherein said insulating means is a plurality of insulating materials.

30. The method of operating a thermoelectric apparatus as claimed in claim 11, wherein said first side fabric and second side fabric are a plurality of colors.

31. The method of operating a thermoelectric apparatus as claimed in claim 11, wherein said body further comprises drawstrings constructed of various materials.

32. The method of operating a thermoelectric apparatus as claimed in claim 11, wherein said cooling means further comprises an electric fan and TEC connected to a frame secured to said body.

33. The method of operating a thermoelectric apparatus as claimed in claim 32, wherein said electric fan is a plurality of sizes.

* * * * *